US010688400B1

(12) United States Patent
Elliott

(10) Patent No.: US 10,688,400 B1
(45) Date of Patent: Jun. 23, 2020

(54) PLAYGROUND STAND-UP SWING APPARATUS AND METHOD

(71) Applicant: Katie Elliott, John Island, SC (US)

(72) Inventor: Katie Elliott, John Island, SC (US)

( * ) Notice: Subject to any disclaimer, the term of this patent is extended or adjusted under 35 U.S.C. 154(b) by 0 days.

(21) Appl. No.: 16/504,921

(22) Filed: Jul. 8, 2019

(51) Int. Cl.
*A63G 9/00* (2006.01)
*A47D 13/00* (2006.01)

(52) U.S. Cl.
CPC ..... *A63G 9/00* (2013.01)

(58) Field of Classification Search
CPC ... A63G 9/00; A63G 9/02; A63G 9/12; A63G 9/14; A47D 13/00; A47D 13/105; A47D 13/107; A47D 13/02; A47D 13/086; A63B 22/001; A63B 2208/0204
USPC ..... 472/118, 120–122, 124, 14, 15; 482/51, 482/52
See application file for complete search history.

(56) References Cited

U.S. PATENT DOCUMENTS 4,861,023 A * 8/1989 Wedman ..... A63B 23/03533 482/51
5,000,443 A 3/1991 Dalebout et al.
5,163,828 A 11/1992 Coddington, Jr.
5,496,235 A 3/1996 Stevens
6,213,922 B1 * 4/2001 Afanasenko ..... A61F 5/01 482/124
6,932,710 B1 8/2005 Hartin
2009/0318267 A1 * 12/2009 Park ..... A61H 3/00 482/8
2011/0263344 A1 10/2011 Brown et al.
2013/0260905 A1 10/2013 Matt

FOREIGN PATENT DOCUMENTS

KR 200393343 Y1 8/2005

* cited by examiner

*Primary Examiner* — Kien T Nguyen
(74) *Attorney, Agent, or Firm* — Southeast IP Group, LLC; Thomas L. Moses

(57) ABSTRACT

A stand-up swing assembly includes a pair of horizontal support bars that are suspended from above by suspension lines. A pair of foot support members are suspended from the support bars so that the foot support members may swing independently from one another. Spacer bars may be positioned above the horizontal support bars to separate the suspension lines for the front support bar from the suspension lines for the rear support bar. The foot support members may take the form of any desired shape, including that of a human foot, a bear paw, or the like, and the suspension lines attached between the foot support members and the horizontal support bars may have elastic properties so that they may stretch and bounce back into a relaxed state.

16 Claims, 6 Drawing Sheets

PLAYGROUND STAND-UP SWING APPARATUS AND METHOD

FIELD OF THE INVENTION

The present invention relates generally to playground swings and swing sets. More specifically, the present invention includes a swing apparatus having horizontally oriented front and rear support bars, a pair of independently swinging foot support members hanging from the support bars, and a plurality of ropes, chains, cables or the like (also collectively referred to herein as "suspension lines") for supporting the apparatus and for attachment to a swing set frame, tree or other stationary object.

BACKGROUND OF THE INVENTION

Swings and swing sets have been a staple on playgrounds all over the world for generations. Traditionally, a simple swing set consisted of a swing set frame having a pair of A-frame supports on either side and a support beam or pole attached between the A-frame supports. Swings are typically attached to the support beam, and generally comprise a board or seat member suspended above the ground by suspension lines attached to the seat member on a bottom end, and to the support beam on an upper end thereof. Other types of swings have been used, as well, including simple rope swings having a knot or knots to hold onto, tire swings suspended from frames or trees, or sometimes more elaborate swing assemblies that may be used by multiple children at one time. One particular type of swing that has been in use in various forms is a stand-up swing, wherein a user may stand on a swinging platform and swing while in a standing position.

Various types of stand-up swings have been developed over the years, and the following references are examples of different types of stand-up swing assemblies and systems. The references below are expressly incorporated herein by reference.

U.S. Pat. No. 5,163,828 Surfer Swing

A swing comprises an overhead support, an elongated rigid platform having a longitudinal axis, a pair of mirror-image hangers, first and second spaced-apart pivots pivotally connecting the lower ends of the hangers to opposite ends of the platform substantially on the platform axis, and third and fourth spaced-apart pivots pivotally connecting the upper ends of the hangers to the overhead support, the pivot axis of all of the pivots being parallel to each other and perpendicular to the platform axis and the spacing of the third and fourth pivots being less than that of the first and second pivots.

U.S. Pat. No. 6,932,710 Board Swing

A board swing which utilizes a pair of somewhat flexible side frame members which are interconnected by a top rail with this top rail being spaced from the supporting surface on which the side frame members rest. An elongated board is mounted by a pair of flexible side members onto the top rail by a pair of pivot means. The elongated board is capable of swinging longitudinally relative to the top rail and is also capable of swinging side-to-side toward and away from the side members. The top rail is pivotable relative to the side members. There may be included a safety member that extends between the pivot means that mounts the flexible supports onto the top rail.

U.S. Application No. 20110263344 Stand-on Playset Swing

A stand-on swing for suspension from a playset structure includes a platform member presenting an upper surface on which the user may stand. The swing also includes a pair of elongated, rigid suspension bars each presenting upper and lower ends. The bars are pivotally connectable to the structure adjacent the upper ends so as to depend therefrom, with the lower ends being spaced from the ground. The swing further includes a pair of lower pivot joints pivotally connecting the suspension bars to the platform member adjacent the lower ends thereof, with the platform member and bars being swingable in a fore-and-aft direction. The bars are bowed so as to present intermediate sections that are spaced further apart than the upper and lower ends. Further, the bars terminate above or generally at the platform member so that the lower ends are prevented from being spaced substantially downward beyond the platform member.

U.S. Application No. 20130260905 Stand Up Swing Apparatus

A recreational amusement stand-up swing apparatus consisting of a singular bracing means anchored to a stationary overhead object. A coupling link element for said bracing means to attach thereto comprising a swivel mechanism for unrestricted spinning rotation. An extension spring providing vertical bouncing means, comprising upper and lower connecting portions attached between said coupling link and a connecting agent centrally located on a line separator element. A line element comprising right and left arm portions equidistantly extending through said line separator and further comprising stopping agents thereon. Said right and left arm portions respectively attaching to right and left supporting bands located atop a rigid platform element and further providing space for a user's feet to be insertably placed therebetween. The right and left arm portions furthermore include line tightener elements thereon for the purpose of adjusting the height of the apparatus relative to the ground.

SUMMARY OF THE INVENTION

In one embodiment, the present stand-up swing assembly includes a pair of horizontal support bars that are suspended from above by suspension lines. A pair of foot support members are suspended from the support bars so that the foot support members may swing independently from one another. Spacer bars may be positioned above the horizontal support bars to separate the suspension lines for the front support bar from the suspension lines for the rear support bar.

In a preferred embodiment, the support bars are positioned an appropriate distance above the foot support members so that a child may grasp either one of the horizontal support bars comfortably, and more preferably, the horizontal support bars are positioned at about chest height when a child is standing on the foot support members.

The foot support members may take any suitable form or shape, and in one embodiment, may be shaped like bear paws or other types of animal feet. Optionally, a portion of the upper surface of the foot support members may be recessed or sunken in, so that a user's feet have a small lip or ridge that helps to maintain their feet in the proper area of the foot support members in order to maintain proper balance. Preferably, each foot support is suspended by four suspension lines: two suspension lines on a front portion thereof, and two suspension lines on a rear portion thereof. The front suspension lines for the foot support members are attached to the front horizontal support member, and the rear suspension lines are attached to the rear horizontal support member. It is contemplated that the upper suspension lines extending between a frame member and the spacer bars (or a spacer ring) may take the form of springs or elastic material, so that the stand-up swing assembly may bounce. Additionally, the suspension lines that extend between the horizontal support bars (or a horizontal support ring) and the foot support members may take the form of springs or elastic material, so that the foot support members may bounce.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
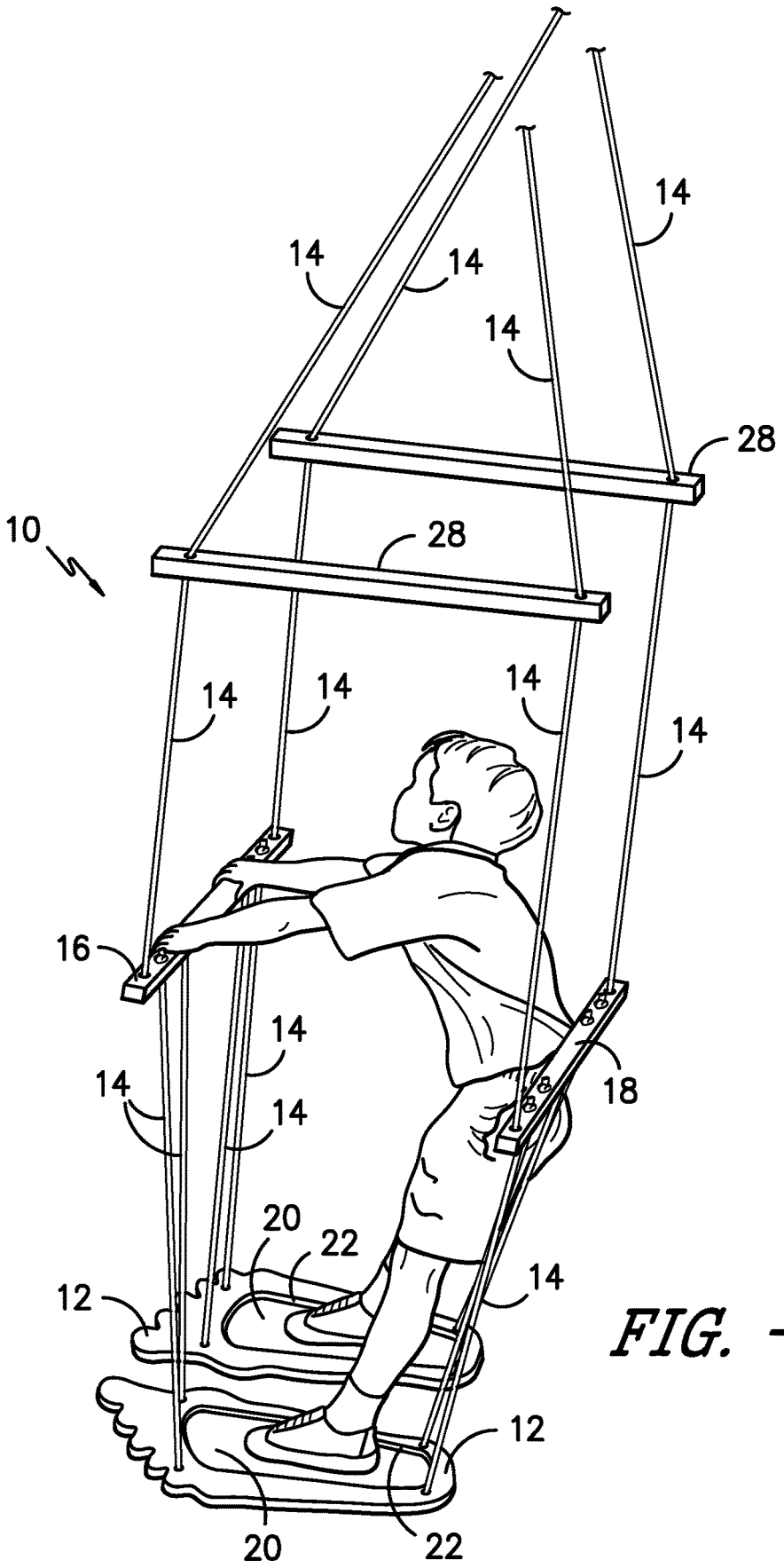
FIG. 1 is a perspective view of one embodiment of a stand-up swing assembly, including a plurality of suspension lines that are connected to a pair of spacer bars, front and rear horizontal support bars, and a pair of independently suspended foot support members.

The present invention, in a first embodiment shown in FIGS. 1-4, is a playground stand-up swing assembly 10 having a pair of foot support members 12 that may swing independently of one another. The assembly 10 is suspended above the ground by a series of suspension lines 14, which may be ropes, chains, cables, or the like. The suspension lines 14 are attached to a stable frame, platform, tree, or any suitable structure that is capable of supporting the weight of the swing assembly 10 and a user, so that the assembly 10 is suspended above the ground. At least two suspension lines 14 are used to support and suspend a front horizontal support bar 16, and another pair of suspension lines 14 are similarly attached to a rear horizontal support bar 18. Spacer bars 28 are disposed above the horizontal support bars 16, 18 to maintain a consistent distance between the suspension lines 14, as shown in FIG. 1.

Foot support members 12 are suspended from the front and rear horizontal support bars 16, 18 so that the foot support members 12 may swing independently from one another. In a preferred embodiment, each foot support member 12 is suspended by four suspension lines 14, as shown in FIG. 1, wherein two suspension lines 14 are attached to the front of the foot support member 12, and two suspension lines 14 are attached to the rear of the foot support member 12. The front suspension lines 14 for each foot support 12 are attached at an upper end to the front horizontal support bar 16, and the rear suspension lines 14 are attached to the rear horizontal support bar 18. In some embodiments, the foot support members 12 may be formed into the shape of bear paws, Bigfoot, duck feet or any other desired shape or configuration. Optionally, each foot support member 12 may have a sunken or recessed area 20 in a central portion of the top surface thereof, providing a lip 22 or ridge that helps a child or user maintain his or her feet in proper position thereon for proper balance and safe operation.

Figure 6:
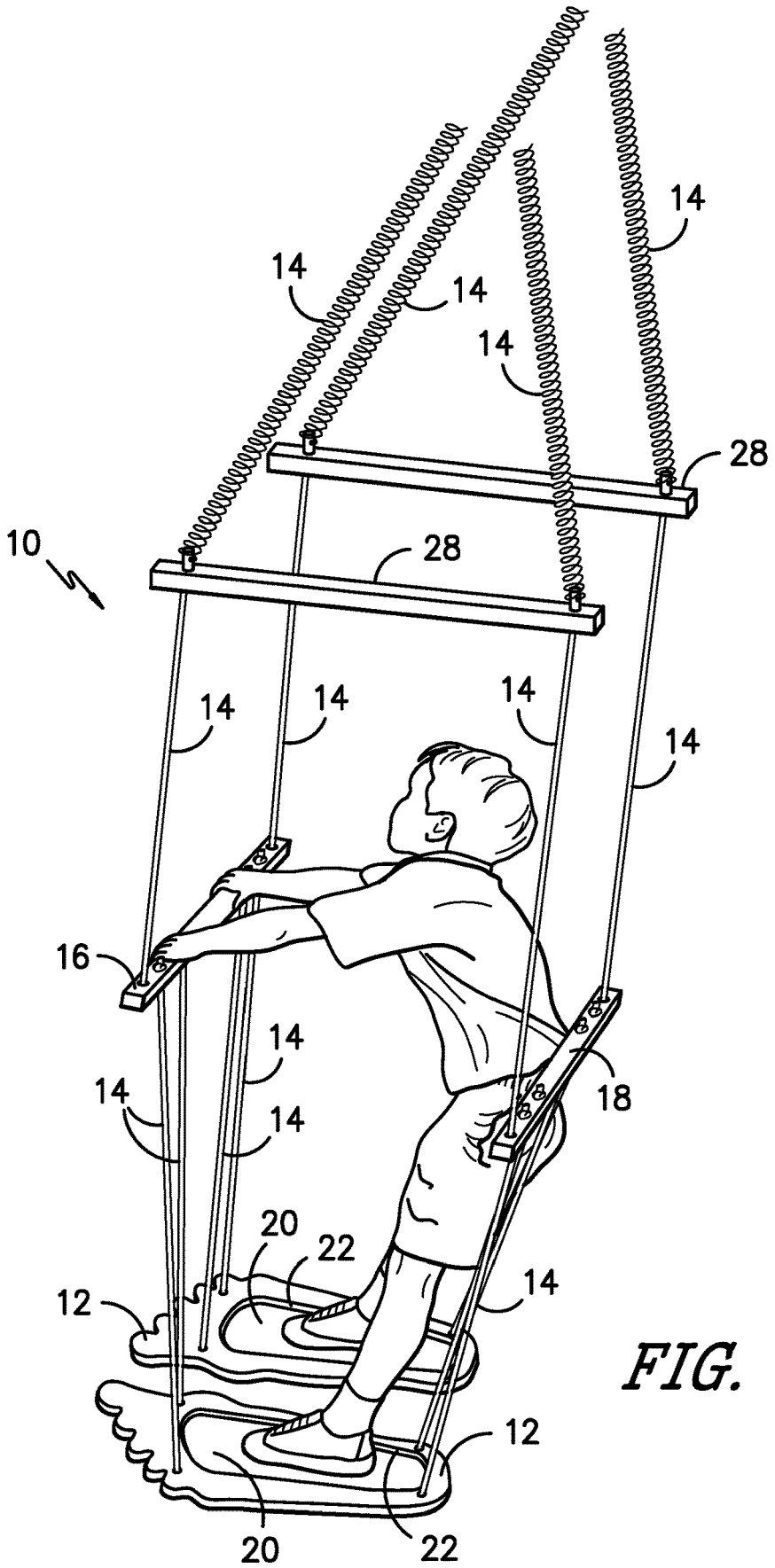
FIG. 6 is a perspective view of one embodiment of a stand-up swing assembly, including a plurality of suspension lines in the form of springs that are connected to a pair of spacer bars, front and rear horizontal support bars, and a pair of independently suspended foot support members.

Additionally, in one embodiment, the suspension lines 14 that run between the horizontal support bars 16, 18 and the foot support members 12 may have elastic properties, such as elastic material or springs, so that they stretch when force (or weight) is applied, and return to the condensed, relaxed state when no pressure is applied, similarly to bungee cords. In this way, the user may swing and bounce while holding onto the front horizontal support bar 16. Further, the suspension lines above the spacer bars may also be formed from an elastic material, or may take the form of springs, as shown in FIG. 6, so that the entire stand-up swing assembly may bounce while a child or person is playing or swinging thereon. It should be understood that any of the suspension lines disclosed herein may be in the form of springs, or may have elastic properties, as desired.

Figure 2:
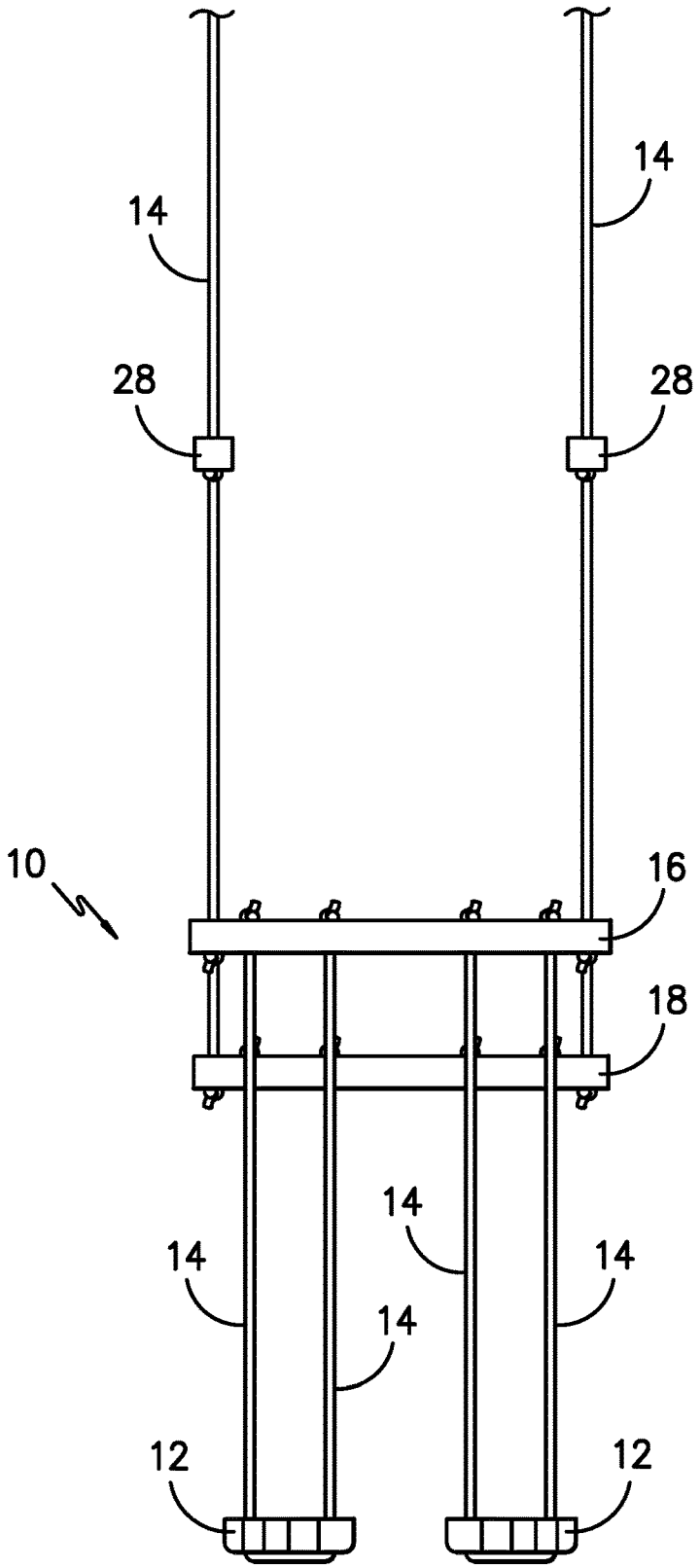
FIG. 2 is a front view of one embodiment of a stand-up swing assembly, including a plurality of suspension lines that are connected to a pair of spacer bars, front and rear horizontal support bars, and a pair of independently suspended foot support members.
Figure 3:
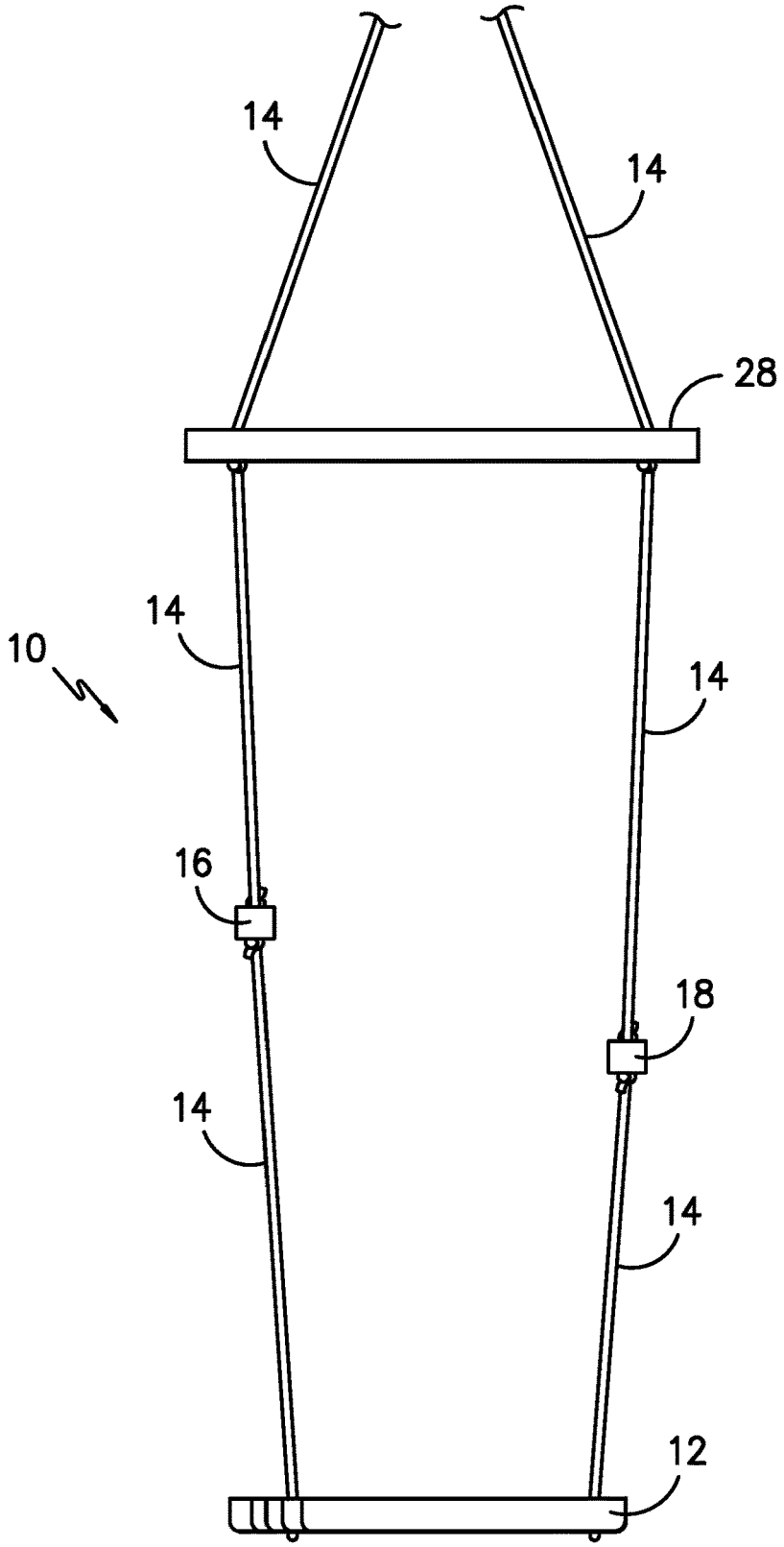
FIG. 3 is a side view of one embodiment of a stand-up swing assembly, including a plurality of suspension lines that are connected to a pair of spacer bars, front and rear horizontal support bars, and a pair of independently suspended foot support members.
Figure 4:
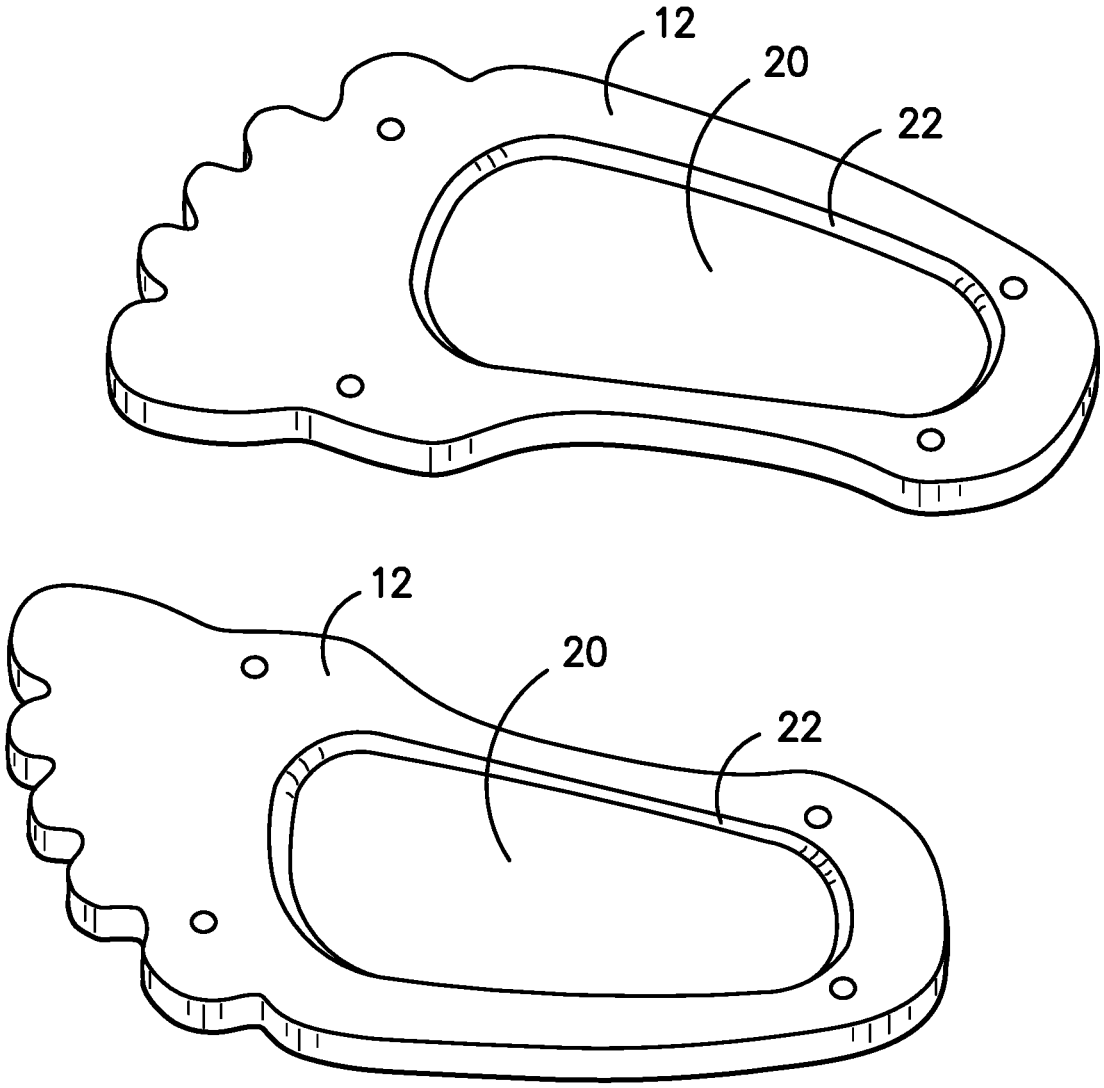
FIG. 4 is a perspective view of one embodiment of foot support members, and in this embodiment, the foot support members are in the shape of large feet or bigfoot feet, and include a recessed portion on the upper surface thereof for placement of a user's feet.

Preferably, the front horizontal support bar 16 is positioned at a distance above the foot support members 12 so that they are at or near chest height for a child. This arrangement allows for a child to easily and comfortably grasp the front support bar 16 with both hands while swinging. The rear horizontal support bar 18, in a preferred embodiment, is positioned slightly lower than the front horizontal support bar 16, as shown in FIGS. 1-3.

Figure 5:
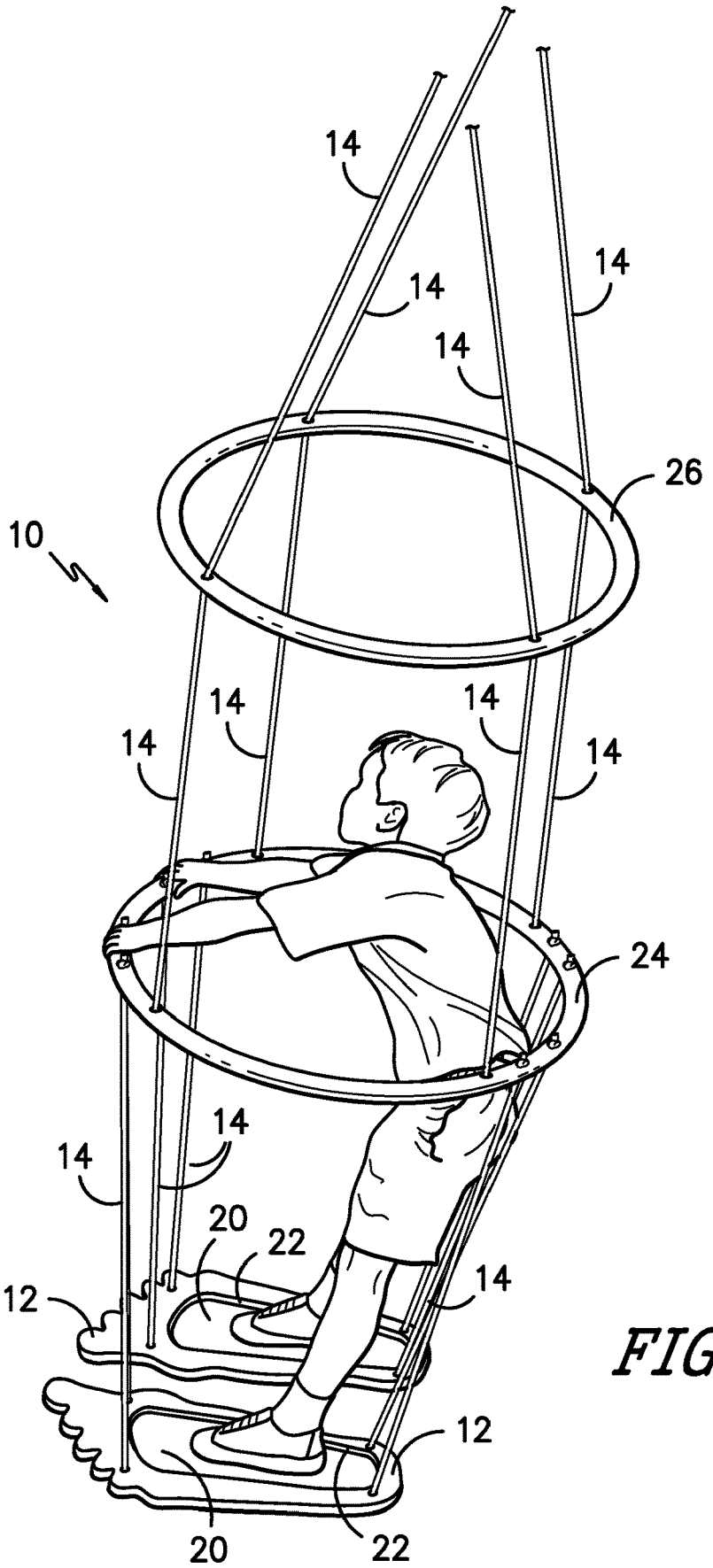
FIG. 5 is a perspective view of one embodiment of a stand-up swing assembly, including a plurality of suspension lines that are connected to a spacer ring, a horizontal support ring, and a pair of independently suspended foot support members.

In another embodiment, a horizontal support ring 24 may be used in place of the front and rear horizontal support bars 16, 18, as shown in FIG. 5. The support ring 24 operates similarly to the above-referenced horizontal support bars 16, 18, wherein suspension lines 14 run from the frame or platform above the assembly 10 down to the support ring 24, and additional suspension lines 14 run downwardly from the support ring 24 to the foot support members 12. It should be understood that other shapes may be used instead of a support ring 24 or bars 16, 18 for hand support and foot member 12 suspension, including a square, oval or rectangular shaped support member.

Generically, the support ring, support square, support bars, and any other mechanism that is used to suspend the foot support members therefrom may be referred to herein as a 'horizontal support member.'

Similarly, a spacer ring 26 may be used in place of the spacer bars 28 to maintain proper spacing between the upper suspension lines 14 above the support ring 26 or the horizontal support bars 16, 18, as shown in FIG. 5. Similarly, the spacer ring 26 could instead take the form of any desired shape, including the shape of a square, rectangle, or any desired shape. The term 'spacer member' may be used herein as a generic phrase to refer to a spacer of any shape that is used to maintain proper spacing between suspension lines 14.

In use, a child or user places his or her right foot on one of the foot support members 12, and places his or her left foot on the other foot support member 12. The user grasps the front horizontal support member 16 with both hands and swings in the traditional manner. Because the foot support members 12 are each separately suspended from the support bars 16, 18 or ring 24, one foot support member 12 may move forward while the other moves in a backward direction in a simulated walking motion, for instance, or the user may simply keep his or her feet side-by-side, or move one foot at a time, as desired.

The swing assembly 10 may be suspended from any suitable structure, such as a frame structure having A-frame supports on either side and a cross-bar or beam extending therebetween that is used for attachment to the upper suspension lines for suspending the swing assembly. It should be understood that many types of swing structures are known in the art, and are described in the references incorporated herein, and any such suitable frame or structure may be used to suspend the previously-described stand-up swing assembly embodiments.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A stand-up swing assembly comprising:

a front horizontal support bar and a rear horizontal support bar, each bar being independently suspended above the ground by at least two upper suspension lines;

a pair of foot support members, wherein each foot member is independently suspended below said horizontal support bars by lower suspension lines;

wherein a front portion of each foot support member is attached to at least two lower suspension lines that are attached to said front horizontal support, and wherein a rear portion of each foot support member is attached to at least two lower suspension lines that attached to said rear horizontal support bar.

2. The stand-up swing assembly set forth in claim 1, further comprising a pair of spacer bars that are attached to said upper suspension lines disposed above said horizontal support bars, wherein each spacer bar is attached to an upper suspension line connected to said front horizontal support bar, and is also attached to an upper suspension line connected to said rear horizontal support bar.

3. The stand-up swing assembly set forth in claim 1, wherein said foot support members are formed into a shape selected from the group consisting of a human foot, an animal foot, a circle, a square, an oval, or any combination thereof.

4. The stand-up swing assembly set forth in claim 1, wherein said lower suspension lines running between said foot support members and said horizontal support bars have elastic properties.

5. The stand-up swing assembly set forth in claim 1, further including a frame structure that is used to support said assembly, wherein said upper suspension lines disposed above said horizontal support bars are attached to said frame structure so that said swing assembly is suspended therefrom.

6. A stand-up swing assembly comprising:

a horizontal support ring suspended above the ground by at least three upper suspension lines;

a spacer ring attached to said upper suspension lines that are used to suspend said horizontal support ring, wherein said spacer ring maintains a constant space or distance between each said upper suspension line; and a pair of foot support members, wherein each foot member is independently suspended below said horizontal support ring by at least three lower suspension lines.

7. The stand-up swing assembly set forth in claim 6, wherein said foot support members are formed into a shape selected from the group consisting of a human foot, an animal foot, a circle, a square, an oval, or any combination thereof.

8. The stand-up swing assembly set forth in claim 6, wherein said lower suspension lines running between said foot support members and said horizontal support ring have elastic properties.

9. The stand-up swing assembly set forth in claim 6, further including a frame structure that is used to support said assembly, wherein said upper suspension lines disposed above said horizontal support ring are attached to said frame structure so that said swing assembly is suspended therefrom.

10. A stand-up swing assembly comprising:

a horizontal support member suspended above the ground by at least two upper suspension lines;

a spacer member attached to said upper suspension lines that are used to suspend said horizontal support member, wherein said spacer member maintains a constant space or distance between each said upper suspension line; and a pair of foot support members, wherein each foot member is independently suspended below said horizontal support member by lower suspension lines.

11. The stand-up swing assembly set forth in claim 10, wherein said foot support members are formed into a shape selected from the group consisting of a human foot, an animal foot, a circle, a square, an oval, or any combination thereof.

12. The stand-up swing assembly set forth in claim 10, wherein said lower suspension lines running between said foot support members and said horizontal support member have elastic properties.

13. The stand-up swing assembly set forth in claim 10, further including a frame structure that is used to support said assembly, wherein said upper suspension lines disposed above said horizontal support ring are attached to said frame structure so that said swing assembly is suspended therefrom.

14. The stand up swing assembly set forth in claim 10, wherein said foot support members include an upper surface having a recessed portion therein for placement of a user's feet.

15. The stand up swing assembly set forth in claim 10, wherein said upper suspension lines are used to hang said stand up swing assembly from a frame, wherein said upper suspension lines are connected to said frame on a first end and said spacer member on a second end.

16. The stand up swing assembly set forth in claim 15, wherein said upper suspension lines between said spacer member and said frame include elastic properties.

* * * * *